United States Patent [19]

Rothenbucher

[11] 3,939,906

[45] Feb. 24, 1976

[54] AIR COOLED EXCHANGER

[75] Inventor: Robert K. Rothenbucher, Bloomingdale, N.J.

[73] Assignee: The Lummus Company, Bloomfield, N.J.

[22] Filed: Dec. 28, 1973

[21] Appl. No.: 429,649

[52] U.S. Cl. ..... 165/76; 165/124; 165/DIG. 1

[51] Int. Cl.[2] ..... F28F 7/00

[58] Field of Search ..... 165/124, 125, 110, 111, 165/76; 98/122

[56] References Cited

UNITED STATES PATENTS

| | | | |
|---|---|---|---|
| 2,780,445 | 2/1957 | Rimbach | 165/124 |
| 2,907,554 | 10/1959 | Heller | 165/125 |
| 3,472,042 | 10/1969 | Shriver et al. | 165/125 X |
| 3,689,367 | 9/1972 | Kassat et al. | 165/122 |

FOREIGN PATENTS OR APPLICATIONS

| | | | |
|---|---|---|---|
| 1,112,032 | 11/1955 | France | 165/124 |
| 908,429 | 10/1962 | United Kingdom | 165/111 |
| 464,531 | 4/1937 | United Kingdom | 165/124 |
| 1,072,635 | 1/1960 | Germany | 165/124 |
| 1,126,430 | 3/1962 | Germany | 165/111 |

*Primary Examiner*—Albert W. Davis, Jr.
*Assistant Examiner*—James D. Liles
*Attorney, Agent, or Firm*—Marn & Jangarathis

[57] ABSTRACT

An air cooled exchanger is provided with a plurality of individual wind screens which are disposed to prevent wind from entering the exchanger, without adversely affecting normal cooling air flow. The load of the wind screens is carried by the exchanger; in particular, the tube frame.

1 Claim, 3 Drawing Figures

FIG. 1
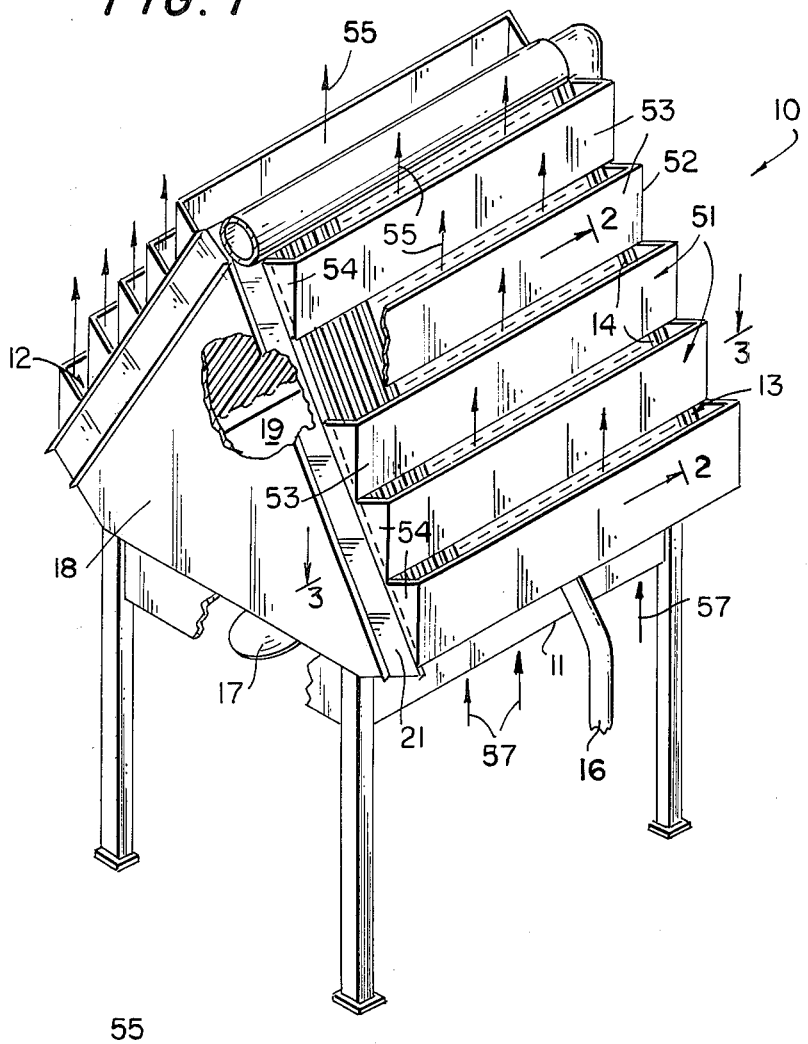
FIG. 2
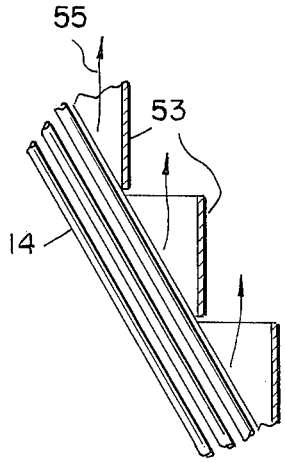
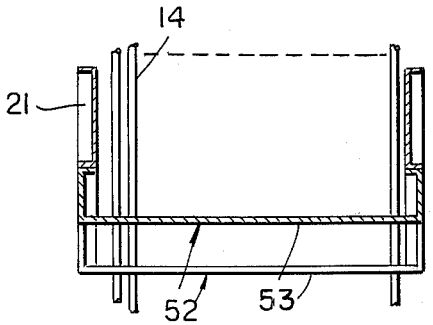
FIG. 3

AIR COOLED EXCHANGER

The present invention relates to heat exchangers, and more particularly to air cooled heat exchangers.

In air cooled heat exchangers, in which ambient air is used as the cooling medium, the fluid to be cooled is introduced into a plurality of tubes disposed in a tube bank, and a stream of ambient air is caused to flow over and in contact with the tubes to effect cooling of fluid therein. In such heat exchangers, the exterior of the tubes are exposed to the atmosphere, and on windy days, as a result of wind entering the tube bundle, the operation of the heat exchanger is difficult to control. The effect of high wind velocity is especially aggravated when the tube bundle is disposed in a vertical or inclined plane.

An object of the present invention is to provide an improved air cooled exchanger.

Another object of the present invention is to provide an air cooled exchanger which is not adversely affected by high winds.

These and other objects of the present invention will become more readily apparent from reading the following description thereof.

In accordance with the present invention, the exterior portion of an air cooled heat exchanger, which is to be exposed to the atmosphere, is provided with a plurality of wind screens or shields which are supported over the exterior of the tubes and disposed to prevent wind from entering the tubes without adversely affecting cooling air flow through the tubes.

More particularly, the wind screens or shields are in the form of a plurality of spaced baffles which extend across the width of the tubes. The baffles are spaced over the length of the tubes, with the height of the baffles and the spacing therebetween being coordinated to deflect the wind to thereby prevent wind from entering the tubes. The cooling air, which flows over the tubes, flows through the space between the baffles, whereby normal cooling air flow is not adversely affected by the use of the wind screens.

The load of the wind screens or shields is carried by the heat exchange structure; in particular, the tube frame for the tubes, and accordingly, the screens are preferably designed in a manner such that the screens are evenly distributed loads on the heat exchanger frame whereby the wind screens or shields do not effect the design of the air cooled exchanger structure.

The individual wind screens or shields can be of any shape which best deflects the wind and, accordingly, can be formed straight, curved, etc. The optimum shape of the wind screens can be determined by considering possible wind velocities, angle and shape of tube bundle, etc. The selection of an optimum design is deemed to be within the scope of those skilled in the art from the teachings herein. The wind screens are preferably mounted in a manner such that the baffles extend in a substantially vertical direction when the heat exchanger is in operating position.

The invention will be described with respect to the accompanying drawing wherein:

FIG. 1 is a simplified isometric view, partially broken away, of an embodiment of the air cooled heat exchanger of the present invention;

FIG. 2 is a partial section taken along line 2—2 of FIG. 1; and

FIG. 3 is a partial section taken along line 3—3 of FIG. 1.

Referring to the drawing, there is shown an air cooled heat exchanger, generally designated as 10, mounted on a suitable support structure, generally designated as 11.

As particularly shown, the heat exchanger 10 contains a pair of oppositely inclined tube banks 12 and 13, each of which is comprised of a plurality of spaced, parallel, longitudinally extending, exposed heat exchanger tubes 14 supported in a frame 21. Although the tubes 14 are particularly shown as extending lengthwise, it is to be understood that the present invention is not limited to such a tube disposition. As known in the art, the tubes can extend across the width of the structure and can be in a serpentine form.

A fluid to be cooled is introduced into the top of the tubes 14 of bank 12 and 13 through an inlet manifold 15 and fluid which has been cooled, in the tubes, is withdrawn from the tubes 14 through an outlet pipe at the bottoms of the tube banks 12 and 13, with only the outlet pipe 16 for tube bank 13 being particularly shown. As particularly shown, the tubes of banks 12 and 13 are fed through a common inlet manifold, but it is to be understood, that the present invention is not limited to such an arrangement.

The heat exchanger 10 is further provided with means for causing a stream of air to flow through the tube banks, in the form of a blower or fan 17 positioned at the lower portion and between the tube banks 12 and 13. Alternatively the heat exchanger can be provided with means for causing a stream of air to flow through the tube banks by natural draft. The heat exchanger 10 is further provided with side walls 18 which extend between the tube banks 12 and 13, whereby the fan 17 draws air through the bottom of the exchanger 10 into a chamber 19 disposed between the lower surfaces of the tube banks 12 and 13 for passage through the tube banks.

As hereinabove described, the heat exchanger 10 is of a type well known in the art, which is generally referred to in the art as an A-shaped air cooled heat exchanger, but it is to be understood that the present invention is not limited to such an exchanger.

The upper surfaces of the tube banks 12 and 13 are provided with a plurality of wind shields or screens, generally designated as 51, in the form of a plurality of spaced imperforate baffles 52, which extend across the width of the tube banks 12 and 13. The baffles 52, as particularly shown, are comprised of a wind deflecting front wall 53 and triangularly shaped side walls 54, with the baffles being individually mounted on the frame 21 of the tube bank; e.g., by welding or bolting whereby the frame 21 carries the load of the wind screens. The baffles 52 are preferably mounted on the tube bank in a manner such that the baffles are substantially vertical when the heat exchanger is mounted for operation, in that such a position, as shown, is best suited for deflecting wind, without adversely affecting cooling air flow through the tube bank.

The front walls 53 of the baffles 52 are longitudinally spaced from each other, whereby cooling air flowing through the exposed tubes 14 can flow from the tube banks parallel to the front walls 53 and into the atmosphere. The front walls 52 are spaced from each other and have a height such that wind is deflected and prevented from entering the exposed tubes 14, without adversely affecting cooling air flow from the exposed tubes into the atmosphere. Accordingly, the rear surface of front walls 53 of baffles 52 in combination with the side walls 54 channel the cooling air upwardly from the exposed tubes 14, as designated by arrows 55, and the front surfaces of walls 53 of baffles 52 function to deflect wind from the tubes 14.

The baffles are particularly illustrated as being planar, but may be of any other shape which will function to deflect wind from the tube banks; e.g., the baffles can be curved.

In general, the spacing between the baffles and the height of the baffles are coordinated in a manner such that the top of the front wall 52 is in a plane at or above the bottom of the front wall of the next succeeding baffle 51.

In operation, a fluid to be cooled flows from the inlet manifold through tubes 14, in banks 12 and 13, wherein the fluid is cooled by cooling air which passes over the tubes. The cooled fluid is withdrawn through outlet pipe 16.

Cooling air is drawn through the bottom of the heat exchanger into the chamber 19 by means of the blower or fan 17, as designated by arrows 57. The cooling air flows from the chamber 19 over the tubes 14 and exits into the surrounding atmosphere between baffles 52 as designated by arrows 55. In the event of high winds, the operation of the heat exchanger 10 is not affected in that the baffles 52 function to deflect the wind and prevent the wind from contacting the tubes 14.

It is to be understood that the present invention is not to be limited to the air cooled exchanger particularly described with reference to the drawing in that, as should be apparent to those skilled in the art, the teachings of the invention, in their broadest aspect, are not limited to a particular heat exchanger structure. For example, the present invention is also applicable to the so-called V-shaped air cooled exchanger, with the wind screens or shields being placed on the exterior surface of the tube banks. In such an embodiment, the cooling air enters the tube banks between the baffles for cooling fluid in the heat exchange tubes and exits from the tubes at the interior side of the exchanger. The present invention, however, is particularly suited for the A-shaped type of air cooled exchanger.

The present invention is particularly advantageous in that the operation of the air cooled heat exchanger is improved as a result of the fact that its operation is not subject to being upset by changes in atmosphere wind conditions. Moreover, such a result is achieved without adversely affecting normal cooling air flow through the tubes. Furthermore, the improved operation is achieved without the necessity of changing the structural design of the exchanger in that the load of the wind screen is born by the frame of the tube bank.

These and other advantages should be apparent to those skilled in the art.

Numerous modifications and variations of the invention are possible in light of the above teachings, and therefore, within the scope of the appended claims the invention may be practised otherwise than as particularly described.

What is claimed:

1. An air cooled heat exchanger, comprising:

a pair of tube banks positioned in oppositely inclined vertical planes to define an A-shape, each of said tube banks having exposed tubes supported in a tube plane;

a pair of side walls connected to the tube banks to define a chamber having an open bottom between the side walls and the lower portion of the tube banks;

means for passing fluid through the tubes;

means for drawing air from the atmosphere into the open bottom of the chamber to pass air upwardly through the tube banks and into the surrounding atmosphere; and a plurality of individual and separate wind shields for each tube bank, said wind shields each being comprised of a wind defecting front wall and integral triangularly shaped side walls, said side walls being attached to the tube frame of each of the tube banks whereby each of the wind shields are separately supported by the tube frame, said front walls being disposed in a substantially vertical plane, each of said front walls extending across the width of the tube banks and being spaced over the length thereof to prevent wind from passing through each of the tube banks when the tube banks are exposed to the atmosphere and permitting air to flow through the tube banks and upwardly to the atmosphere between the wind shields and tube banks, said wind shields being supported as evenly supported loads on the tube frame.

* * * * *